US007123737B2

(12) United States Patent
Ham

(10) Patent No.: US 7,123,737 B2
(45) Date of Patent: Oct. 17, 2006

(54) EAR CLASP HEADSET

(75) Inventor: Soohyun Ham, Santa Cruz, CA (US)

(73) Assignee: Plantronics, Inc., Santa Cruz, CA (US)

( * ) Notice: Subject to any disclaimer, the term of this patent is extended or adjusted under 35 U.S.C. 154(b) by 611 days.

(21) Appl. No.: 10/076,164

(22) Filed: Feb. 13, 2002

(65) Prior Publication Data

US 2004/0008855 A1 Jan. 15, 2004

(51) Int. Cl.
*H04R 25/00* (2006.01)

(52) U.S. Cl. ..... 381/381; 381/330

(58) Field of Classification Search ..... 381/370, 381/374–381, 375, 330, 380, 385, 322, 328, 381/364, 182, 365; 2/209; D14/205–206, D14/188, 192; 181/128–130; 379/425–427, 379/430–433, 420.04, 428.02; 455/459.1, 455/575.2, 41.1–41.3

See application file for complete search history.

(56) References Cited

U.S. PATENT DOCUMENTS

| | | | | | |
|---|---|---|---|---|---|
| 1,587,643 | A * | 6/1926 | Harman | 181/135 |
| D242,724 | S | 12/1976 | Brodie | D26/14 H |
| 4,893,344 | A * | 1/1990 | Tragardh et al. | 381/381 |
| 4,932,052 | A | 6/1990 | Lo | 379/430 |
| 5,113,428 | A * | 5/1992 | Fitzgerald | 455/575.2 |
| D350,757 | S | 9/1994 | Carpenter | D14/223 |
| 5,412,736 | A * | 5/1995 | Keliiliki | 381/381 |
| 5,708,724 | A * | 1/1998 | Burris et al. | 381/370 |
| 5,729,615 | A | 3/1998 | Yang | |
| 5,761,298 | A * | 6/1998 | Davis et al. | 379/430 |
| 5,790,683 | A | 8/1998 | Salzani | |
| 6,038,329 | A | 3/2000 | Lee | |
| 6,097,827 | A * | 8/2000 | Yang | 381/375 |
| 6,101,260 | A * | 8/2000 | Jensen et al. | 381/381 |
| 6,373,942 | B1 * | 4/2002 | Braund | 379/430 |
| 6,418,230 | B1 * | 7/2002 | McDonald et al. | 381/381 |
| 6,449,374 | B1 * | 9/2002 | Skulley et al. | 381/381 |
| D470,836 | S | 2/2003 | Amae et al. | |
| D475,694 | S * | 6/2003 | Bey et al. | D14/206 |
| 6,580,800 | B1 | 6/2003 | Yamasaki et al. | |
| 6,603,863 | B1 * | 8/2003 | Nagayoshi | 381/380 |
| D480,072 | S * | 9/2003 | Ham | D14/223 |
| 6,771,790 | B1 * | 8/2004 | Liu | 381/385 |
| 6,785,396 | B1 * | 8/2004 | Shirata | 381/381 |
| 6,819,772 | B1 * | 11/2004 | Amae | 381/379 |

(Continued)

FOREIGN PATENT DOCUMENTS

DE 43 29 635 A1 9/1995

(Continued)

OTHER PUBLICATIONS

Article: Plantronics MX100 cellular headset. c2002.*

(Continued)

*Primary Examiner*—Curtis Kuntz
*Assistant Examiner*—Phylesha L Dabney
(74) *Attorney, Agent, or Firm*—MacPherson Kwok Chen & Heid LLP

(57) ABSTRACT

An ear clasp headset includes a speaker capsule for transmitting sound to a user's ear, wherein the speaker capsule is capable of contacting an inner recess of the user's ear, a headset body operably coupled to the speaker capsule, wherein the headset body is capable of contacting an outer portion of the user's ear, and a headset tail operably coupled to the headset body, wherein the headset tail comprises a curved structure capable of flexing open and close for contacting a lower portion of the user's ear. Advantageously, the apparatus and method of the present invention provide a headset with improved comfort, stability, and fit in the user's ear.

31 Claims, 6 Drawing Sheets

U.S. PATENT DOCUMENTS

| | | | | |
|---|---|---|---|---|
| 2001/0017926 | A1* | 8/2001 | Vicamini | 381/380 |
| 2003/0174854 | A1 | 9/2003 | Amae | |
| 2004/0008855 | A1* | 1/2004 | Ham | 381/381 |
| 2004/0101151 | A1* | 5/2004 | Webber | 381/328 |

FOREIGN PATENT DOCUMENTS

| | | |
|---|---|---|
| GB | 2 347 042 | 8/2000 |
| WO | WO 97/27721 | 7/1997 |
| WO | WO 99/60816 | 11/1999 |
| WO | WO 00/19685 | 4/2000 |

OTHER PUBLICATIONS

"Ring Earphones", at http://humanfeels.com/eng/pro/pro_03.html, p. 1, http://humanfeels.com/eng/pro/pro_03a.html, pp. 1-2, printed Feb. 8, 2002.

Certified Accessories, front cover of catalog and product p. 5, distributed at Consumer Electronics Show 2002, Las Vegas, NV.

National Cellular Buyer's Guide, front cover and product p. 23 distributed at Consumer Electronics Show 2002, Las Vegas, NV.

* cited by examiner

EAR CLASP HEADSET

BACKGROUND

1. Field of the Invention

This invention generally relates to headsets containing earphones and, more particularly, to an "in-the-ear" type headset apparatus with improved wearing comfort and stability.

2. Description of Related Art

Telephone headsets are gaining popularity in and out of the workplace as more and more users either have jobs requiring that they spend a substantial amount of time on the telephone or users simply desire to listen or speak on the telephone with their hands free to perform other tasks.

One type of headset, which can incorporate one or two earphones for monaural or stereo listening, is known as an "in-the-ear" type headset, which employs earphones that fit into the cavum area, or entrance to a user's middle ear.

Hands-free headsets which are placed in the ear must adapt to a wide variety of ear shapes and sizes in order to fit a large percentage of users. Comfort, stability, and aesthetics are key elements that must be met in order for a headset to be acceptable to the end user. Unfortunately, previous headsets designed with consideration for both elements of comfort and stability have typically been burdened with a large form factor.

A conventional method for making an in-the-ear headset fit a wide variety of ear sizes comfortably has been to offer a foam cushion that slips over the earpiece to provide a larger profile to fill the ear. Another approach has been to offer a selection of incrementally-sized accessories which attach to the earpiece to allow for custom fitting to the user's ear. These previous methods have typically required that the output face of the earphone be forcefully maintained in the ear of the user to maintain stability. Consequently, a major disadvantage of these previous methods has been discomfort from the high contact forces against the ear. Another disadvantage has been the lack of stability in the ear after a period of time in which the earphone may become dislodged by the aggregate of movements by the user.

Therefore, there is a need in the art for a headset apparatus that is comfortable, stable on the ear, universally fitting, and capable of user customization.

SUMMARY

In accordance with the present invention, an apparatus and method are provided for acoustic coupling to a user's ear with an improved earphone headset that allows for greater comfort, stability, and fit when used.

In one aspect of the invention, an ear clasp headset comprises a speaker capsule for transmitting sound to a user's ear, wherein the speaker capsule is capable of contacting an inner recess of the user's ear; a headset body operably coupled to the speaker capsule, wherein the headset body is capable of contacting an outer portion of the user's ear; and a headset tail operably coupled to the headset body, wherein the headset tail comprises a curved structure capable of flexing open and close for contacting a lower portion of the user's ear.

In another aspect of the present invention, an ear clasp headset comprises a speaker capsule for transmitting sound to a user's ear from a transducer; a headset body operably coupled to the speaker capsule, wherein the headset body comprises a curved structure housing at least one wire operably coupling the transducer to an audio source; a headset tail operably coupled to the headset body, wherein the headset tail comprises a curved structure capable of flexing open and closed for contacting a lower portion of the user's ear; and a microphone operably coupled to the headset body for transmitting sound from the user.

In yet another aspect of the invention, a method for donning an ear clasp headset comprises providing an ear clasp headset; inserting a speaker capsule of the ear clasp headset into an inner recess of a user's ear for transmitting sound from the speaker capsule to the user's ear; placing a headset tail of the ear clasp headset in an open position away from a headset body of the ear clasp headset; positioning the headset body for contacting an outer portion of the user's ear; and placing the headset tail in a closed position for contacting a lower portion of the user's ear.

Advantageously, the present invention provides multiple contact areas with the ear to distribute weight and pressure such that the headset is more stable on the ear and the required contact force against the cavum area of the ear is reduced, which translates into enhanced, long-term headset user comfort. Further, the present invention allows for large variations in ear size and shape so as to be universally fitting.

These and other features and advantages of the present invention will be more readily apparent from the detailed description of the embodiments set forth below taken in conjunction with the accompanying drawings.

BRIEF DESCRIPTION OF THE DRAWINGS

The use of similar reference numerals in different figures indicates similar or identical items.

DETAILED DESCRIPTION

Figure 1C:
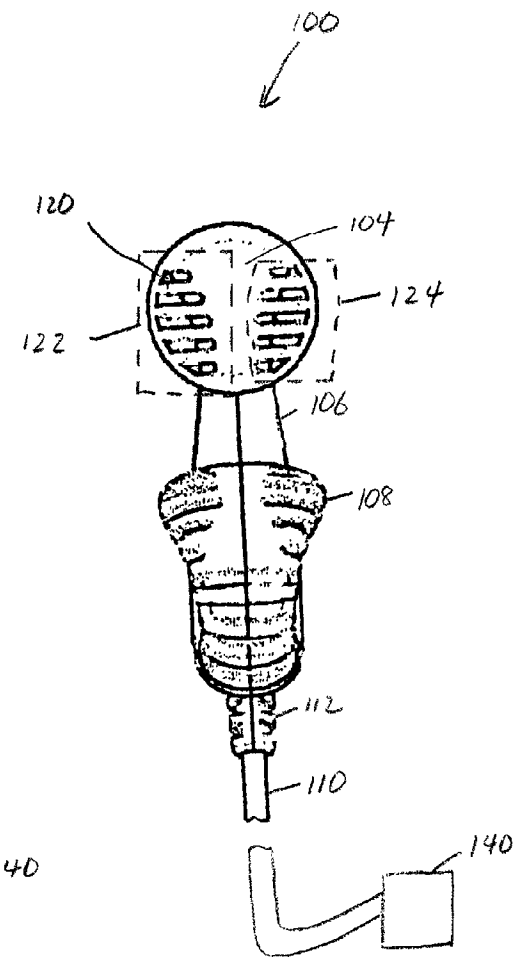
FIGS. 1A through 1C illustrate several simplified schematic views of an ear clasp headset in accordance with an embodiment of the present invention.
Figure 1B:
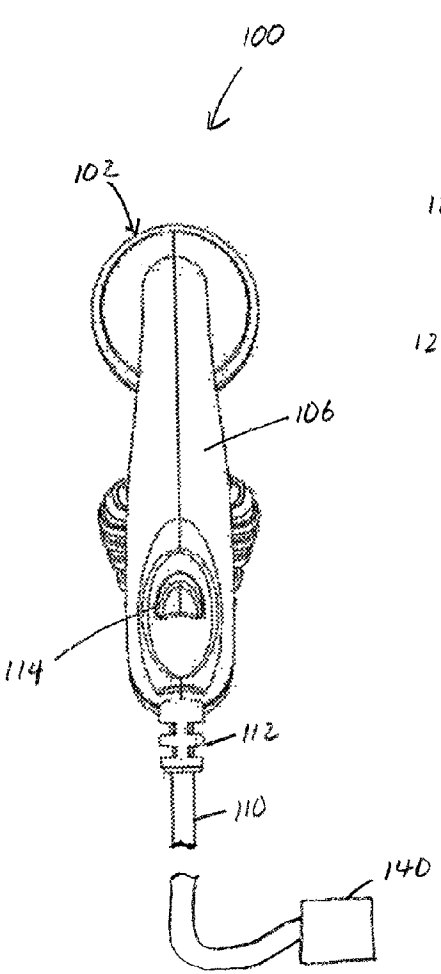
Figure 1A:
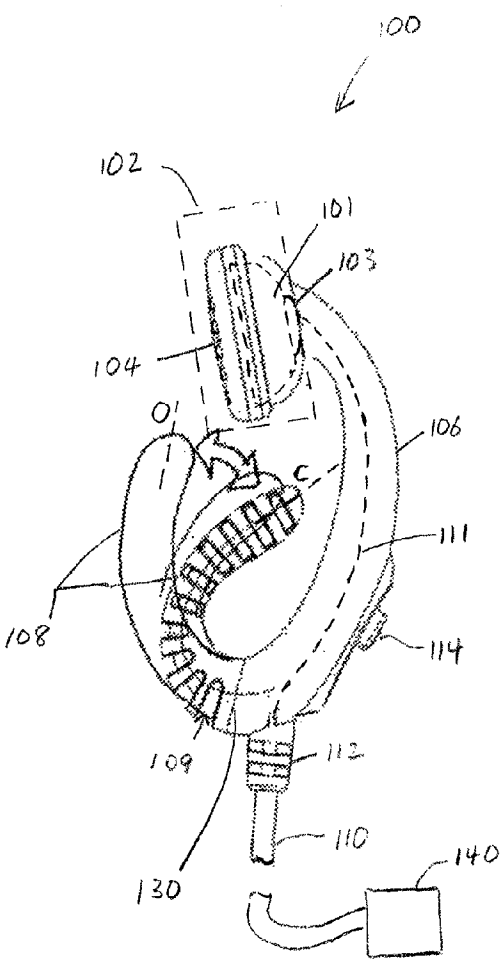

As shown in FIGS. 1A through 1C, the present invention provides an ear clasp headset 100 for use with an audio source 140, such as a telephone handset, a cellular phone, a personal computer, or a communication network. However, the invention is not limited to receiving a signal from a specific audio source. Further, ear clasp headset 100 may be used for either monaural or stereo listening by applying an ear clasp headset 100 to one or each ear of a user.

FIGS. 1A through 1C illustrate a profile view, back view, and front view, respectively, of ear clasp headset 100 in accordance with an embodiment of the present invention. Ear clasp headset 100 includes a speaker capsule 102 for insertion into a recess of a headset user's ear, such as the cavum area, which leads to the ear canal. Speaker capsule 102 includes a speaker faceplate 104 and encloses a transducer 101, such as an electro-acoustic speaker (outline shown by dashed lines). Transducer 101 receives audio signals from audio signal source 140 and may comprise a known type of electromagnetic, piezoelectric, or electrostatic type of driving element, or a combination thereof, or even some other form of driving element, for generating sound waves from the output face of the transducer and toward speaker faceplate 104. Speaker capsule 102 is sized to be as small as the enclosed transducer will allow to maximize fit into the recess of the user's ear. Accordingly, speaker capsule 102 may seal to the inner features of the user's ear to block out external noise while directing sound from the transducer to the eardrum.

Referring specifically to FIG. 1C, in one embodiment, speaker faceplate 104 includes openings 120 such that sound is directed from the transducer toward the user's eardrum, regardless of whether speaker capsule 102 is in the right ear or the left ear. Faceplate 104 includes two sets of openings 122 and 124 aligned side by side from each other and increasing in separation moving vertically from the bottom of faceplate 104 towards the top of faceplate 104. Openings 120 direct sound from the transducer toward the user's eardrum at angles away from the center of faceplate 104. Accordingly, the set of openings 122 on the left side of faceplate 104 is able to direct sound toward the left and therefore the user's right eardrum and the set of openings 124 on the right side of faceplate 104 is able to direct sound toward the right and therefore the user's left eardrum. Thus, advantageously, sound is transmitted through faceplate 104 toward the user's eardrum regardless of whether speaker capsule 102 is placed in the right ear or the left ear. However, the invention is not limited to a specific speaker faceplate and any faceplate may be used to direct sound from the transducer to the user's eardrum.

Referring to FIG. 1A, speaker capsule 102 is operably connected to headset body 106 at a first interface 103. In one embodiment, speaker capsule 102 is movably connected to headset body 106 by a movable joint, such as a ball-in-socket joint or a hinge mechanism, allowing speaker capsule 102 to have multidirectional movement in relation to headset body 106. A movable joint which allows for multi-directional movement increases comfort and fit for the headset user when speaker capsule 102 is inserted into the ear and ear clasp headset 100 is fully mounted. In another embodiment, speaker capsule 102 and headset body 106 are coupled as a single structure along first interface 103, thereby not allowing for any movement between speaker capsule 102 and headset body 106.

Headset body 106 includes a curved structure operably connected to speaker capsule 102. In one embodiment, headset body 106 includes a curved and hollow structure made of hard plastic for housing speaker wires 111 (shown by dashed lines) which operably connect the transducer in speaker capsule 102 to an audio source. Speaker wires 111 which extend outside of headset body 106 can be protected inside a cable 110, which is made from a non-conductive material in one embodiment. Optionally, a cable boot 112 is operably connected to headset body 106 where cable 110 enters headset body 106 and surrounds a portion of cable 110 adjacent to the outside of headset body 106. Cable boot 112 is made from a flexible material in one embodiment and protects the area of cable 110 just outside of headset body 106 from possible causes of disconnection, such as undesired bending and pulling that might cause a malfunction. The invention is not limited to using the aforementioned materials and headset body 106, cable boot 112, and cable 110 may be made of any protective material, such as rubber or polymer compounds.

The geometry of headset body 106 was developed with consideration for ergonomic factors. The profile of headset body 106, as shown in FIG. 1A, does not follow a circular curve but a more oblique or flat curve so as to closely follow the outer ear. Such a profile allows headset body 106 to hug the outer ear and improves headset stability by dampening unstable rotational forces when headset 100 is fully mounted on the user's ear. Advantageously, the shape of headset body 106 still allows for variations in ear size and shape so as to be universally fitting.

Figure 2A:
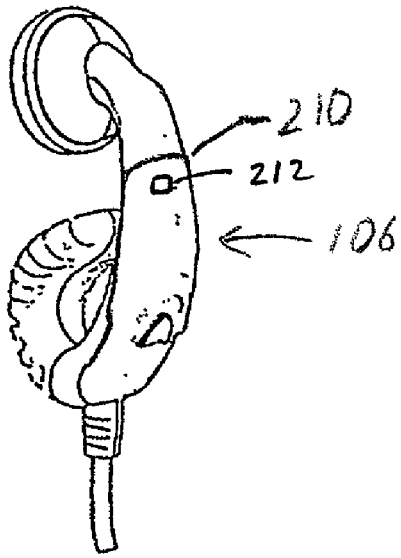
FIGS. 2A and 2B illustrate simplified schematic views of an extension mechanism for the headset body of an ear clasp headset in accordance with an embodiment of the present invention.
Figure 2B:
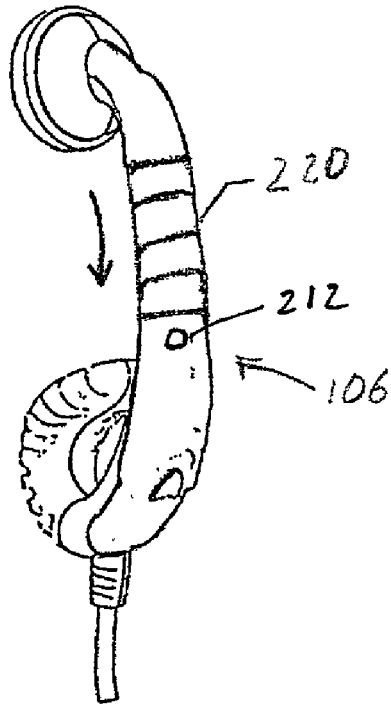

To further stability and universal fit of ear clasp headset 100, headset body 106 may include the option of an extension structure 220 for extending the length of headset body 106, as shown in FIGS. 2A and 2B. In this embodiment, headset body 106 is capable of extension at division 210 through extension structure 220, such as a sliding or collapsing mechanism with multiple frames. Speaker wires 111 (FIG. 1A) are operably housed inside headset body 106 with enough slack to allow for possible extension of headset body 106 to a maximum length caused by extension structure 220 (FIG. 2B). Extension structure 220 may also include a locking mechanism 212 to lock headset body 106 at a selected length.

In another embodiment, headset body 106 further includes a call switch 114, as illustrated in FIGS. 1A and 1B. In one embodiment, call switch 114 includes a printed circuit board operably embedded into headset body 106 and operably connected in line with speaker wires 111 to allow for quick access and actuation of the answer/end call function.

Figure 3A:
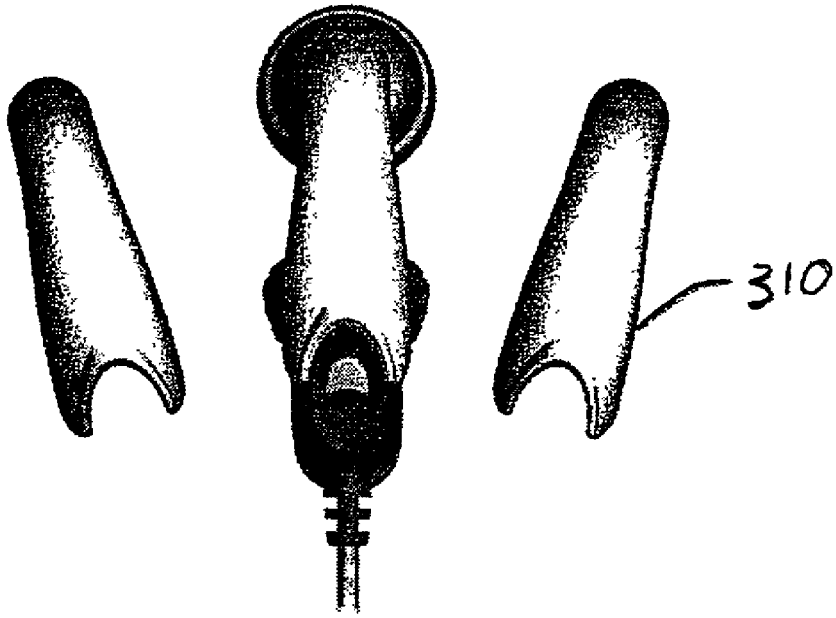
FIGS. 3A and 3B illustrate simplified schematic views of a user customizable accent of an ear clasp headset in accordance with an embodiment of the present invention.
Figure 3B:
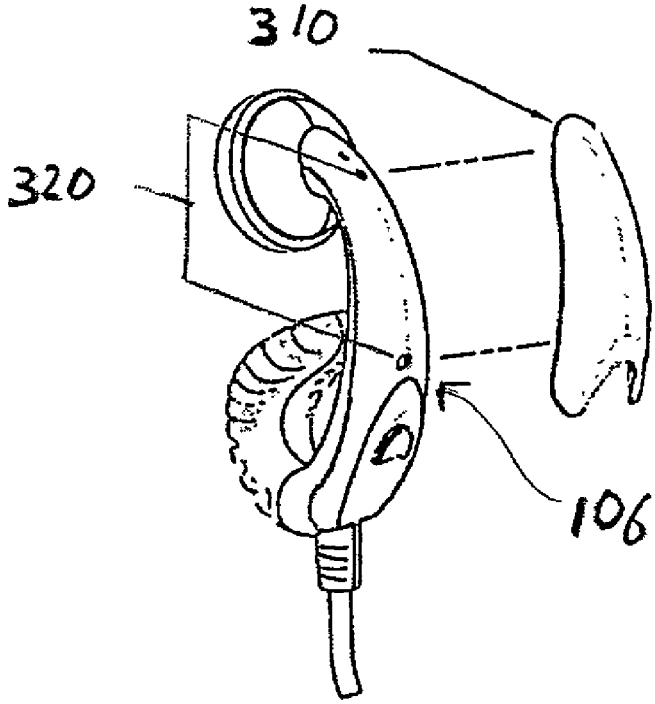

In yet another embodiment of the present invention, headset body 106 includes accent 310, as illustrated in FIGS. 3A and 3B. The user can customize the appearance of headset body 106 by attaching one of an assortment of accents 310 with varying colors to make the ear clasp headset unique in appearance. In one embodiment, accent 310 may be attached to headset body 106 using holes 320 in combination with tabs on accent 310. Alternatively, accent 310 may be attached to headset body 106 by using a combination of snap-on tabs on accent 310 with receiving tabs on the sides of headset body 106. However, the invention is not limited to using the aforementioned methods and mechanisms and any attachment method and mechanism may be used to attach accent 310 to headset body 106, such as the use of an adhesive or screw.

Referring back to FIGS. 1A through 1C, ear clasp headset 100 of the present invention includes a headset tail 108 operably connected to headset body 106 at a second interface 130. Headset tail 108 allows for improved headset stability by providing the ability to wrap around and capture a lower portion of the user's ear, as will be discussed in greater detail below.

Headset tail 108 may be made from any material that allows for comfortable and safe biasing against the user's ear. In one embodiment, headset tail 108 is made from non-abrasive and flexible material, such as a soft elastomer or other polymer.

Headset tail 108 also may be formed into any shape for comfortable and safe biasing against the user's ear. In one embodiment, headset tail 108 is shaped to become wider near the end of headset tail 108 moving away from interface 130, as shown in FIGS. 1B and 1C. Advantageously, headset tail 108 may be shaped to be wider than headset body 106 at at least one area of the tail to give the user easier access to headset tail 108 when manipulating headset tail 108 into an open position "O" for donning and doffing the headset, as discussed below. Further, a wider headset tail design allows for more surface contact with a portion of the user's ear to make the headset more stable when worn. Optionally, a tapering tip acts as an advantageous lead-in feature and makes it easier for the user to put on the headset However, the invention is not limited to using the aforementioned shapes for headset tail 108 and any shape or shapes may be used which allow for a comfortable and safe fit on the user's ear.

In addition, headset tail 108 may include grooves 109 on the sides of headset tail 108 following a rib design. Advantageously, grooves 109 allow headset tail 108 to flex out to fit thicker ears for a more adaptive fit. Further, grooves 109 provide the user with grip for manipulating headset tail 108 when donning and doffing the headset, as discussed below.

Referring to FIG. 1A, in one embodiment, headset tail 108 includes a structure with a profile that curves toward speaker capsule 102 from interface 130, and is at rest in a closed position "C" curving toward headset body 106. The combination of the initial profile shape and material of headset body 106 and grooves 109 give headset tail 108 a spring-like actuation such that while donning the headset, a user may hold headset tail 108 in an open position "O" away from headset body 106 end then release headset tail 108 to return headset tail 108 to closed position "C" while capturing a lower portion of the user's ear (see FIGS. 1A, 4A, and 4B). When headset tail 108 is held in open position "O" away from headset body 106, grooves 109 near interface 130 flex to become narrower and partially give the spring-like actuation for returning headset tail 108 to closed position "C" when headset tail 108 is released. In another embodiment headset tail 108 may comprise a wire which allows the user to bend headset tail 108 into a desired position to clip onto a portion of the user's ear. Alternatively, headset tail 108 may be coupled to headset body 106 by a movable joint, such as a spring mechanism, that allows headset tail 108 to capture a lower portion of the user's ear. However, the invention is not limited to using the aforementioned mechanism and methods and any mechanism and method may be used to allow the user to articulate headset tail 108 to capture a lower portion of the user's ear.

Figure 4C:
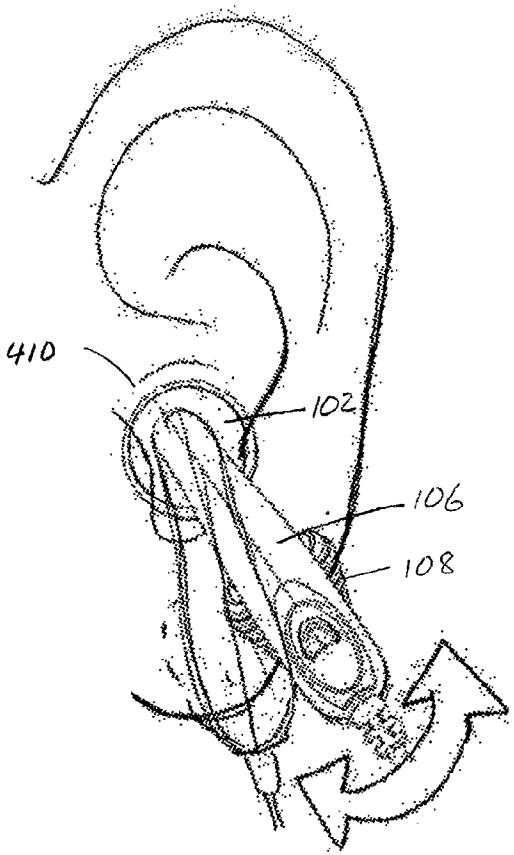
FIGS. 4A through 4C illustrate simplified schematics of an ear clasp headset mounted onto an ear in accordance with an embodiment of the present invention.
Figure 4B:
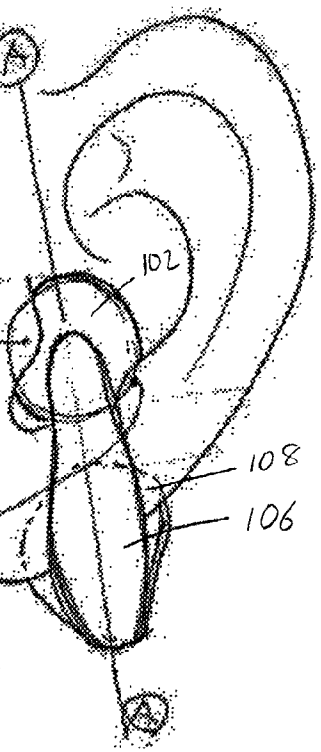
Figure 4A:
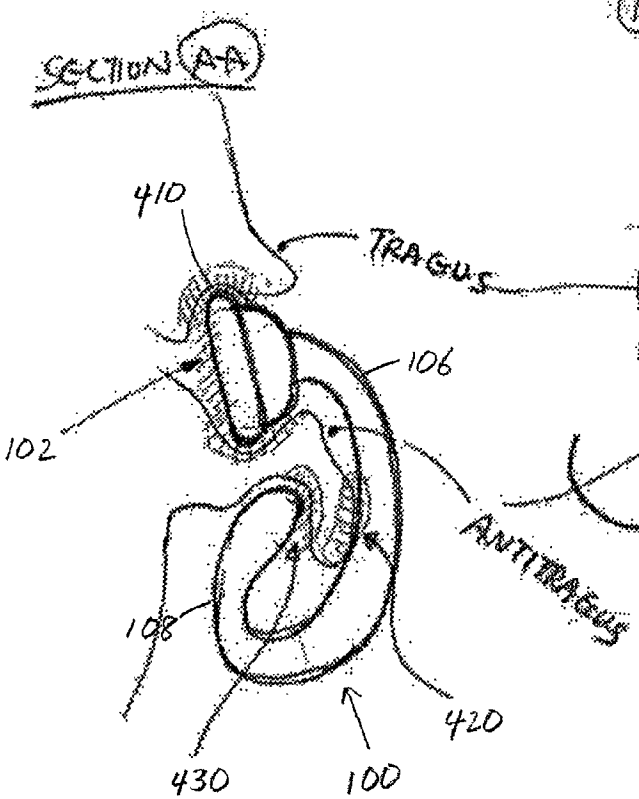

Referring now to FIGS. 4A and 4B, when headset 100 is fully mounted on the ear, headset 100 may contact the user's ear at three areas to provide effective acoustic coupling with improved stability and comfort. Speaker capsule 102 may first be placed in the cavum area, for example between the ear's tragus and antitragus, to form a first contact area 410 between the cavum area and speaker capsule 102. As headset tail 108 is held in the open position and headset body 106 is positioned over the outer ear, a second contact area 420 is formed between a lower portion of the outer ear, such as the earlobe, and headset body 106. When headset tail 108 is released or formed into a closed position to capture a lower portion of the user's ear, a third contact area 430 is formed between the back of the ear, such as the back of the earlobe or the back of the cavum area, and headset tail 108.

The multiple contact areas with the ear distribute weight and pressure such that headset 100 is more stable on the ear and the required contact force against the cavum area of the ear is reduced, which translates into enhanced, long-term headset user comfort. Advantageously, after the ear clasp headset is mounted, the headset may be further adjusted, as shown in FIG. 4C, by pivoting the headset about the speaker capsule/cavum contact area 410 such that headset body 106 and headset tail 108 may contact various areas along the lower portion of the user's outer ear for a tighter or looser fit.

Figures 5A, 5B:
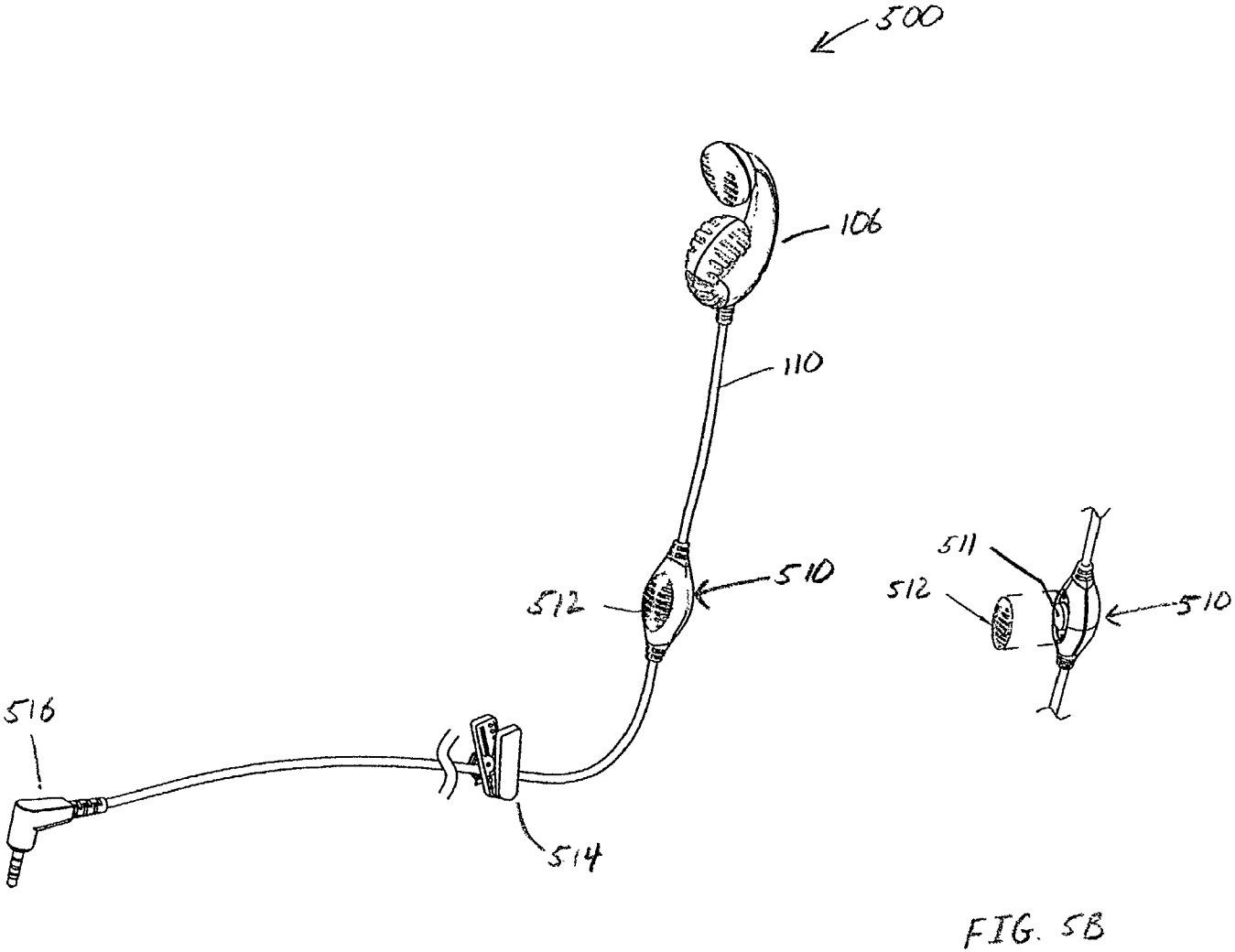
FIGS. 5A and 5B illustrate simplified schematic views of an ear clasp headset with microphone, clothing pin, and connector, in accordance with an embodiment of the present invention.
Figure 6C:
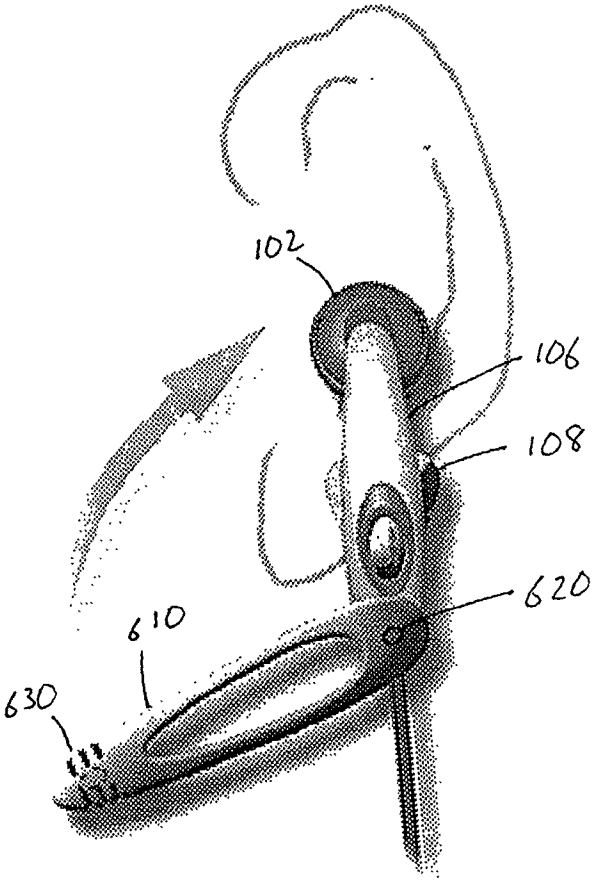
FIGS. 6A through 6C illustrate simplified schematic views of a boom microphone of an ear clasp headset in accordance with an embodiment of the present invention.
Figure 6B:
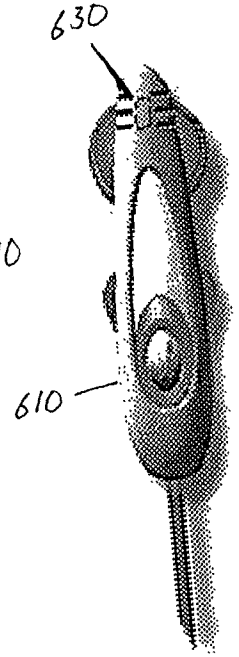
Figure 6A:
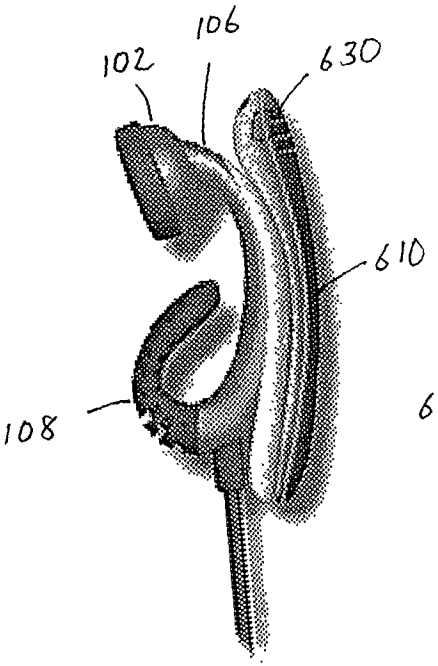

Referring now to FIGS. 5A and 5B, ear clasp headset system 500 of the present invention may include a microphone 511 to enable two-way voice communication by the user. In one embodiment, a microphone 511 is operably enclosed in a pod 510 below headset body 106 in line with cable 110. Microphone faceplate 512 provides a mesh opening on one side of pod 510 to allow the user to transmit voice signals as desired. In another embodiment, as illustrated in FIGS. 6A through 6C, microphone 630 may be attached to boom 610, which is operably connected to headset body 106. Optionally, as shown in FIGS. 6B and 6C, a movable joint, such as a swinging mechanism 620, may couple boom 610 to headset body 106, such that boom 610 may swing back and forth to the user's mouth and lock into a position as desired by the user.

Referring back to FIG. 5A, headset 500 may also include a clothing pin 514 for keeping microphone pod 510 close to the user's mouth and/or cable 110 close to the user's body. Further, a connector 516 operably connects the ear clasp headset to an audio source, such as a telephone handset, cellular telephone, or a computer, and a transmitter for sending voice signals from the user.

The above-described embodiments of the present invention are merely meant to be illustrative and not limiting. It will thus be obvious to those skilled in the art that various changes and modifications may be made without departing from this invention in its broader aspects. Therefore, the appended claims encompass all such changes and modifications as falling within the true spirit and scope of this invention.

I claim:

1. An ear clasp headset, comprising:

a speaker capsule for transmitting sound to a user's ear, wherein the speaker capsule is capable of contacting an inner recess of the user's ear;

a headset body operably coupled to the speaker capsule, wherein the headset body has a curved profile substantially perpendicular to the plane of the user's ear; and a headset tail operably coupled to the headset body, wherein the headset tail includes a curved structure with a free end capable of flexing open and close for contacting a lower portion of the user's ear.

2. The ear clasp headset of claim 1, wherein the speaker capsule comprises a transducer and a speaker faceplate.

3. The ear clasp headset of claim 2, wherein the speaker faceplate is capable of directing sound from the transducer to the user's right or left eardrum.

4. The ear clasp headset of claim 1, wherein the speaker capsule and the headset body are operably coupled together by a movable joint.

5. The ear clasp headset of claim 1, wherein the headset body is capable of contacting the user's earlobe.

6. The ear clasp headset of claim 1, wherein the headset body comprises a curved structure following a non-circular curve.

7. The ear clasp headset of claim 1, wherein the headset body further comprises a detachable accent.

8. The ear clasp headset of claim 1, wherein the headset body further comprises an extension mechanism for elongating the headset body to a selected length.

9. The ear clasp headset of claim 1, wherein the headset body and headset tail are operably coupled together by a movable joint.

10. The ear clasp headset of claim 1, wherein the headset tail comprises an elastomer with grooves.

11. The ear clasp headset of claim 1, wherein the headset tail comprises a wire.

12. The ear clasp headset of claim 1, wherein the headset tail is capable of contacting aback portion of the user's ear.

13. The car clasp headset of claim 1, further comprising a microphone operably coupled to the headset body.

14. The ear clasp headset of claim 13, wherein the microphone is embedded in a pod that is along at least one wire coupling the transducer to an audio source.

15. The ear clasp headset of claim 13, wherein the microphone is operably coupled to a boom which is operably coupled to the headset body.

16. The ear clasp headset of claim 1, wherein the headset body includes a call switch.

17. An ear clasp headset, comprising:

a speaker capsule Lot transmitting sound to a user's ear from a transducer;

a headset body operably coupled to the speaker capsule, wherein the headset body includes a tuned structure housing at least one wire operably coupling the transducer to an audio source, the curved structure having a curved profile substantially perpendicular to the plane of the user's car;

a headset tail operably coupled to the headset body, wherein the headset tail includes a curved structure with a free end capable of flexing open and close for contacting a lower portion of the user's ear; and a microphone operably coupled to the headset body for transmitting sound from the user.

18. The ear clasp headset of claim 17, wherein the speaker capsule includes a faceplate capable of directing sound from the transducer to the user's right or left eardrum.

19. The ear clasp headset of claim 17, wherein the speaker capsule and the headset body arc operably coupled together by a movable joint.

20. The ear clasp headset of claim 17, wherein the headset body is capable of contacting an outer portion of the user's ear.

21. The ear clasp headset of claim 17, wherein the headset body further Includes a detachable accent.

22. The ear clasp headset of claim 17, wherein the headset body further comprises a call switch.

23. The ear clasp headset of claim 17, wherein the headset body further comprises an extension mechanism for elongating the headset body to a selected length.

24. The ear clasp headset of claim 17, wherein the headset body and the headset tail are operably coupled together by a movable joint.

25. The ear clasp headset of claim 17, wherein the headset tail is capable of contacting a back portion of the user's car.

26. The ear clasp headset of claim 17, wherein the headset tail comprises an elastomer with grooves.

27. The ear clasp headset of claim 17, wherein the microphone is embedded in a pod that is along the at least one wire operably coupling the transducer to the audio source.

28. The ear clasp headset of claim 17, wherein the microphone is operably coupled to a boom which is operably coupled to the headset body.

29. A method for donning an ear clasp headset, said method comprising:

inserting a speaker capsule of the ear clasp headset into an inner recess of a user's ear for transmitting sound from the speaker capsule to the user's ear;

placing a headset tail of the ear clasp headset in an open position away from a headset body of the ear clasp headset, the headset body having a curved profile substantially perpendicular to the plane of the user's ear;

positioning the headset body over the user's outer ear; and placing the headset tail in a closed position to clip a lower portion of the user's ear between the headset tail and the headset body.

30. The method of claim 29, said method farther comprising: adjusting the length of the headset body, as desired by the user.

31. The method of claim 29, said method further comprising: adjusting the position of the headset by pivoting the headset about a contact point between the speaker capsule and the inner recess of the user's ear.

* * * * *